US012742338B1

(12) United States Patent
Pellerin et al.

(10) Patent No.: US 12,742,338 B1
(45) Date of Patent: Sep. 22, 2026

(54) COLUMBARIUM APPARATUS

(71) Applicant: MEMORIAM, LLC, Breaux Bridge, LA (US)

(72) Inventors: Andre Pellerin, Breaux Bridge, LA (US); Raymond Pellerin, Breaux Bridge, LA (US)

( * ) Notice: Subject to any disclaimer, the term of this patent is extended or adjusted under 35 U.S.C. 154(b) by 0 days.

(21) Appl. No.: 17/490,780

(22) Filed: Sep. 30, 2021

Related U.S. Application Data

(60) Provisional application No. 63/086,157, filed on Oct. 1, 2020.

(51) Int. Cl.
*E04H 13/00* (2006.01)

(52) U.S. Cl.
CPC ..... *E04H 13/008* (2013.01)

(58) Field of Classification Search
CPC .... E04H 13/003; E04H 13/006; E04H 13/008
See application file for complete search history.

(56) References Cited

U.S. PATENT DOCUMENTS 271,453 A * 1/1883 Heidmeyer ..... E04H 13/003 52/103
364,661 A * 6/1887 Miller ..... E04H 13/003 52/103
5,517,790 A * 5/1996 Jennings ..... E04H 13/003 52/168
5,881,505 A * 3/1999 Larkin, III ..... E04H 13/006 211/85.27
2010/0300016 A1* 12/2010 Eickhof ..... E04H 13/006 52/587.1
2016/0376810 A1* 12/2016 Eickhof ..... E04H 13/003 52/133
2017/0298648 A1* 10/2017 Eickhof ..... G09F 17/00

FOREIGN PATENT DOCUMENTS

DE 102009036803 A1 * 2/2011 ..... E04H 13/008
WO WO-2014031168 A1 * 2/2014 ..... E04H 13/006

* cited by examiner

*Primary Examiner* — Christine T Cajilig
(74) *Attorney, Agent, or Firm* — Sarah B. Dupont

(57) ABSTRACT

A columbarium apparatus for use in providing a customizable and personalized means for securely holding and maintaining a family member's cremated remains and/or pet remains. A columbarium apparatus comprising an interior housing and an exterior covering, wherein said interior housing provides an extremely strong and rigid frame in order to withstand any outdoor elements, to be able to hold and support a variety of different ornamental objects, and to be easily transported, and wherein said exterior covering provides an aesthetic design appeal.

5 Claims, 7 Drawing Sheets

COLUMBARIUM APPARATUS

BACKGROUND OF THE INVENTION

Field of the Invention

The present invention pertains to a device for use in providing a customer with a customizable and personalized columbarium apparatus for use in securely holding and maintaining a family member's cremated remains and/or pet remains. The present invention comprises a modular design in order to give the customer a desired look and to provide a proper size and amount of urn capacity that best fits the customer's family's needs. More particularly, the present invention comprises a columbarium apparatus for use in housing at least one urn in a waterproof manner within any outdoor setting or environment.

BRIEF DESCRIPTION OF THE PRIOR ART

A columbarium is a room or structure designed as a final resting place to house cremated remains. Additionally, an ossuary is a structure designed as a final resting place to house multiple, co-mingled bags of cremated remains.

Columbaria are permanent structures with banks of inbuilt cremation niches (similar to cubbyholes, but with secure fronts) that store urns, thus holding cremated remains of the deceased. Generally, after cremation, the deceased's ashes are placed into an urn, which is then fixed into the niche space of a columbarium.

A columbarium can be either a free-standing unit, part of a mausoleum, or another building, and thus, it can serve as a popular and affordable way to store cremated remains. A columbarium can be large or small, private or public. Some columbaria have glass-front niches, which allow you to see the cremation urns and any personal artifacts placed with them. Additionally, columbaria can be in an indoor, climate-controlled environment or an outdoor garden environment. Columbaria can also be part of a cemetery or a stately standalone structure.

SUMMARY OF THE INVENTION

The columbarium apparatus of the present invention generally comprises a housing member, wherein said housing member comprises a box-like structure having a base member, a plurality of sides, and a top plate. Said housing member is manufactured from a substantially strong and rigid, yet light and flexible metal material, such as, for example, aluminum, or any other similar material exhibiting like characteristics, wherein said aluminum material is used for providing a frame and structure to said housing member. For example, said housing member generally comprises an approximately ⅝" aluminum base and top plate, wherein said base and top plate are connected by way of an approximately ¼" aluminum sheet that is welded together. As a result, this assembly creates an extremely strong and rigid structure in order to withstand any outdoor elements and to be able to hold and support a variety of different ornamental objects. In addition, said aluminum base is able to withstand being moved, dropped, or knocked over, thereby allowing said apparatus to be easily transportable and thus preventing said apparatus from breaking during transport.

In a preferred embodiment, said columbarium apparatus of the present invention generally comprises an exterior covering, wherein said exterior covering is manufactured from a granite material, or any other similar decorative stone exhibiting like characteristics. Said exterior covering is attachably connected to an exterior surface of said aluminum base, thereby allowing said exterior covering to surround and encapsulate a plurality of sides of said aluminum base in order to provide an aesthetic design element to said columbarium apparatus. For example, a two (2 cm) centimeter or a three (3 cm) centimeter granite slab can be installed around said aluminum base structure via a number of different attachment means, such as, for example, an epoxy, or a plurality of stainless steel bolts, in order to ensure that the granite is permanently affixed to said aluminum structure.

Additionally, in a preferred embodiment, said columbarium apparatus of the present invention comprises a removable door member, wherein said removable door member is manufactured from a granite material, or any other similar decorative stone exhibiting like characteristics. Said door member can be removed to insert an urn, or said cremated remains, within an interior reservoir of said columbarium apparatus. Said door member is then temporarily secured back into place by way of a plurality of magnets and is then securely sealed by way of caulking said door to said sides of said columbarium apparatus.

In a preferred embodiment, a standard model of said columbarium apparatus can house a plurality of—typically two (2)—urns, or units, within said columbarium apparatus; however, it is to be noted that said columbarium apparatus can comprise a variety of different number of urns, up to approximately twelve (12) urns, or units. Moreover, said columbarium apparatus is modular in construction, and thus, can be stackable in order to accommodate a customer's needs. As such, said columbarium apparatus can comprise a variety of different configurations.

In a preferred embodiment, said columbarium apparatus is customizable, wherein any different type of object can be displayed on top of said structure, such as, for example, a vase, a sculpture, or any other kind of object or décor that can fit on top of a unit that is preferred by a customer. Moreover, the present invention can comprise a customizable obelisk that can also be bolted to the top of said housing member. Additionally, the present invention can comprise a bronze sculpture, or a sculpture having any other similar material, exhibiting like characteristics, mounted on top of a base unit, as well as being able to be mounted on top of a stackable unit.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
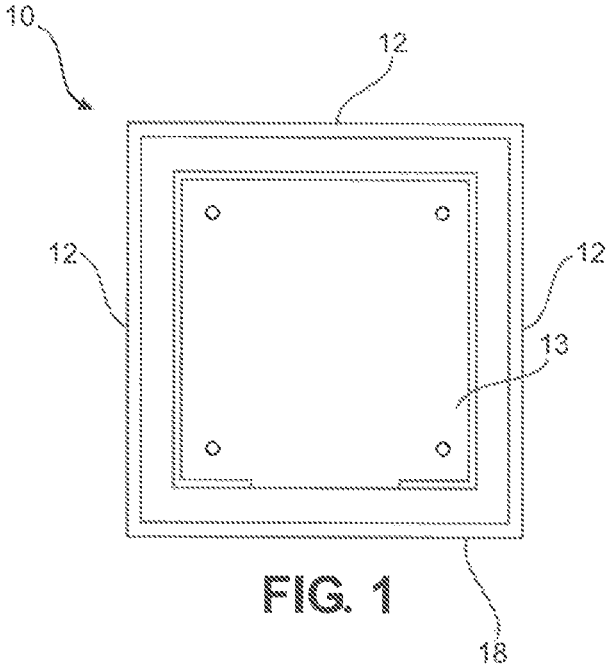
FIG. 1 depicts an aerial view of a preferred embodiment of an interior housing member of a columbarium apparatus of the present invention.

The present invention comprises a columbarium apparatus 100 generally comprising an interior housing member 10 and an exterior covering member 20. Said interior housing member 10 can be manufactured from a substantially strong, yet light and flexible metal material, such as, for example, aluminum, or any other similar material exhibiting like characteristics, wherein said aluminum material is used for providing a frame and structure to said housing member 10. As such, the aluminum material of said interior housing member 10 creates an extremely strong and rigid structure in order to withstand any outdoor elements and to be able to hold and support a variety of different ornamental objects. In addition, said aluminum housing member 10 is able to withstand being moved, dropped, or knocked over, thereby allowing said apparatus 100 to be easily transportable and thus preventing said apparatus 100 from breaking during transport.

Additionally, said exterior covering member 20 can be manufactured from a granite material, or any other similar decorative stone exhibiting like characteristics, wherein said exterior covering 20 is attachably connected to an exterior surface 19 of said aluminum housing member 10, thereby allowing said exterior covering 20 to surround and encapsulate said aluminum housing member 10 in order to provide an aesthetic design element to said columbarium apparatus 100.

Moreover, the present invention comprises a columbarium apparatus 100 generally comprising an obelisk 30, wherein said obelisk 30 further comprises an interior frame member and an exterior covering. Said interior frame member is manufactured from a substantially strong, yet light and flexible metal material, such as, for example, aluminum, or any other similar material exhibiting like characteristics, wherein said aluminum material is used for providing a structure to said obelisk 30. As such, the aluminum material of said interior frame member creates an extremely strong and rigid structure in order to withstand any outdoor elements, in addition to be able to withstand being moved, dropped, or knocked over, thereby allowing said obelisk 30 to be easily transportable and thus preventing said obelisk 30 from breaking during transport.

Additionally, said exterior covering of said obelisk 30 is manufactured from a granite material, or any other similar decorative stone exhibiting like characteristics, wherein said exterior covering of said obelisk 30 is attachably connected to an exterior surface of said interior frame member of said obelisk 30, thereby allowing said exterior covering of said obelisk 30 to surround and encapsulate said interior frame member of said obelisk 30 in order to provide an aesthetic design element to said obelisk 30.

Referring to the drawings, FIG. 1 depicts an aerial view of an interior housing member 10 of said columbarium apparatus 100 of the present invention. Said interior housing member 10 comprises a base member 11 and a plurality of sides 12, wherein said sides 12 are oriented in an upwardly perpendicular manner relative to said base 11. As such, said base 11 and said sides 12 cooperate to form an inner cavity or reservoir 13.

In a preferred embodiment, one of said sides 12 of said interior housing member 10 comprises a substantially rectangular opening 18, wherein said opening 18 allows for an urn to be placed within said interior housing member 10.

Figure 2:
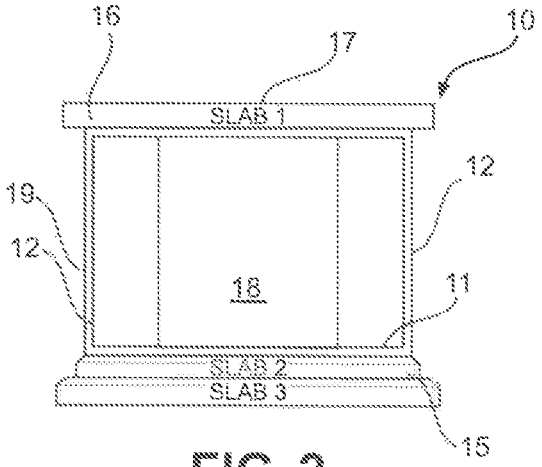
FIG. 2 depicts a side view of a preferred embodiment of an interior housing member of a columbarium apparatus of the present invention.

FIG. 2 depicts a side view of interior housing member 10 of said columbarium apparatus 100 of the present invention. Said interior housing member 10 comprises base member 11 and sides 12, wherein said sides 12 are oriented in an upwardly perpendicular manner relative to said base 11. As such, said base 11 and said sides 12 cooperate to form inner cavity or reservoir 13. Additionally, said interior housing member 10 comprises opening 18, wherein opening 18 is disposed within one of said sides 12, thereby allowing for a means in which an urn can be placed within interior housing member 10.

Moreover, said columbarium apparatus 100 comprises at least one base plate 15 or slab, wherein said base plate 15 comprises a substantially flat and planar surface and can be disposed underneath said base member 11 of said interior housing member 10. Additionally, said columbarium apparatus 100 comprises a top plate 16, wherein said top plate 16 comprises a substantially flat and planar surface. Said top plate 16 is disposed at an opposite end of said base member 11 of said housing member 10 in a perpendicular configuration relative to said sides 12, thereby enclosing said inner reservoir 13 of said housing member 10.

Figure 3:
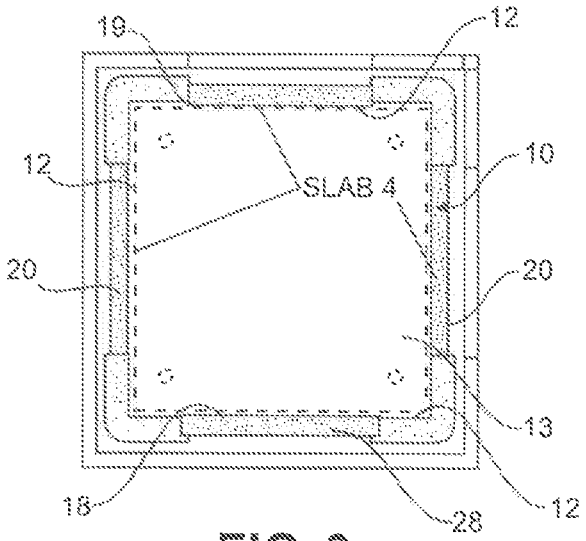
FIG. 3 depicts an aerial view of a preferred embodiment of an interior housing member and an exterior covering of a columbarium apparatus of the present invention.

FIG. 3 depicts an aerial view of said columbarium apparatus 100 of the present invention comprising an exterior covering 20. In a preferred embodiment, said exterior covering 20 comprises a substantially flat and planar surface and is attachably connected to said sides 12 of said interior housing member 10 by way of various attachment means, such as, for example, epoxy, stainless-steel bolts, or any other similar attachment means. As such, said exterior covering 20 surrounds and encapsulates said sides 12 of said interior housing member 10 in order to give said columbarium apparatus 100 an aesthetic appeal.

In a preferred embodiment, said columbarium apparatus 100 of the present invention further comprises said removable door member 28, wherein said door member 28 is manufactured from a substantially granite material, or any other decorative stone material exhibiting like characteristics. Said door member 28 can be removed in order to insert an urn, or said cremated remains, through opening 18 and then within said interior reservoir 13 of said columbarium apparatus 100. Said door member 28 is then temporarily secured back into place by way of a plurality of magnets and is then securely sealed into place by way of caulking said door 28 to said exterior covering 20 that is connected to sides 12 of said columbarium apparatus 100.

Figure 4:
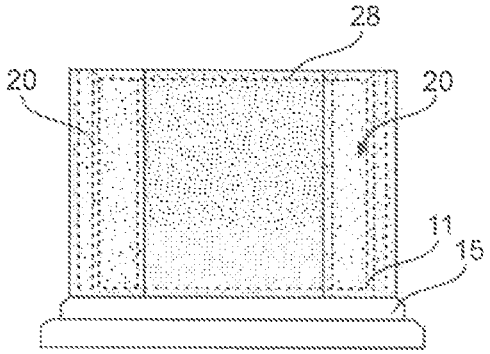
FIG. 4 depicts a side view of a preferred embodiment of an interior housing member and an exterior covering of a columbarium apparatus of the present invention.

FIG. 4 depicts a side view of said columbarium apparatus 100 of the present invention comprising an exterior covering 20. Said exterior covering 20 is attachably connected to an exterior surface 19 of said sides 12 of said interior housing 10, thereby providing columbarium apparatus 100 of the present invention with an aesthetic design element, while also allowing columbarium apparatus 100 to remain relatively lightweight and transportable. Additionally, said door member 28 is oriented in an upwardly perpendicular manner relative to base 11, and said door member 28 is further oriented between exterior covering 20 that is connected to two of said sides 12.

Figure 5:
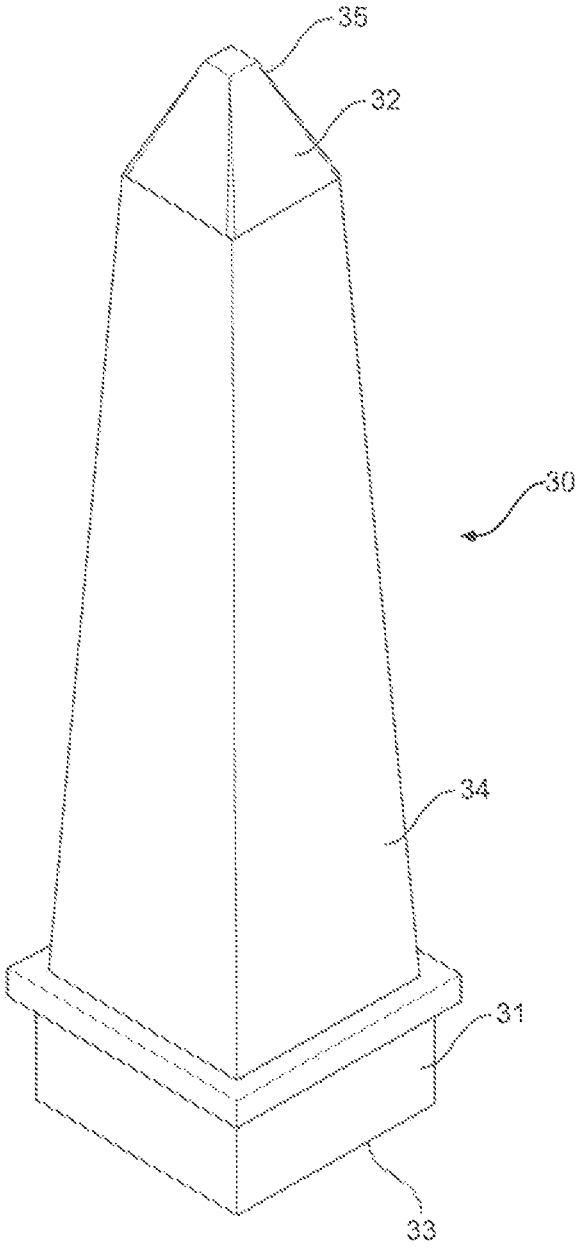
FIG. 5 depicts a side perspective view of a preferred embodiment of an obelisk of a columbarium apparatus of the present invention.
Figure 6:
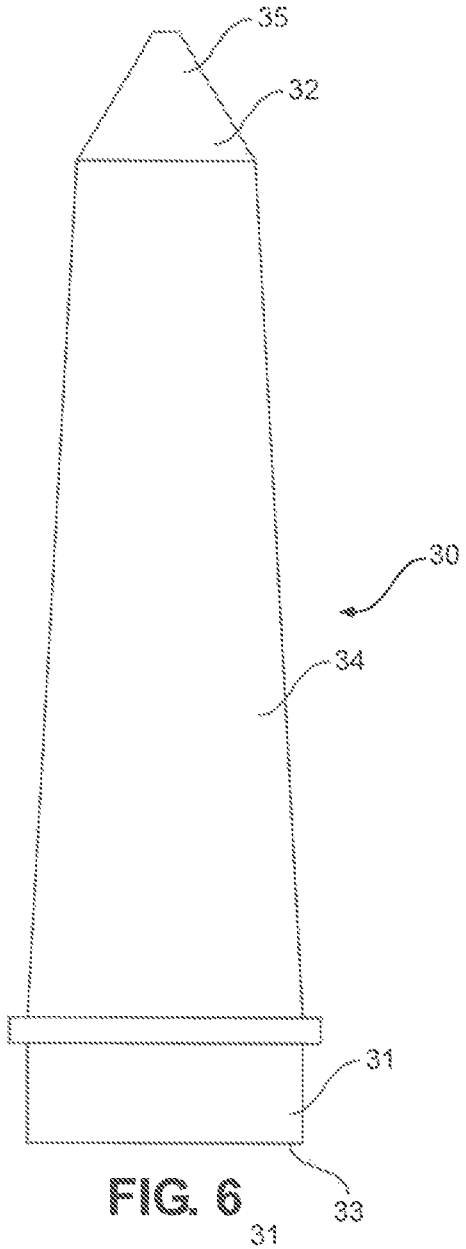
FIG. 6 depicts a side view of a preferred embodiment of an obelisk of a columbarium apparatus of the present invention.
Figure 7:
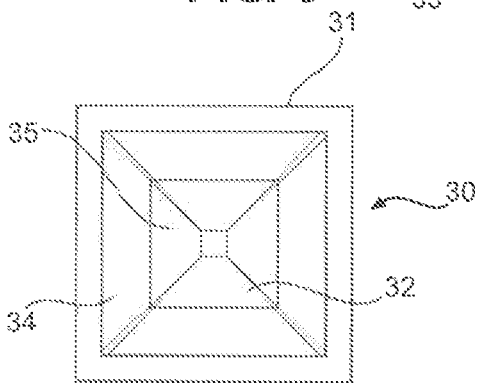
FIG. 7 depicts an aerial view of a preferred embodiment of an obelisk of a columbarium apparatus of the present invention.

FIG. 5 depicts a side perspective view of an obelisk 30 of columbarium apparatus 100, FIG. 6 depicts a side view of obelisk 30 of columbarium apparatus 100, and FIG. 7 depicts an aerial view of obelisk 30 of columbarium apparatus 100, wherein said obelisk 30 is disposed on top of a top surface 17 of said top plate 16 of said housing member 10. It is to be noted that for purposes herein, said obelisk can also be interchangeably used as an ossuary in order to hold multiple bags of cremated remains. Thus, while the term obelisk is used herein, the term ossuary can also be interchanged.

Said obelisk 30 comprises an interior frame member, wherein said interior frame member is manufactured from an aluminum metal material, wherein said frame member comprises a structure that is configured in a particular manner and shape to form an interior cavity. Said aluminum frame member of said obelisk is then surrounded by way of an exterior covering, wherein said exterior covering is manufactured from a granite material, or any other similar decorative stone exhibiting like characteristics. Said exterior covering is attachably connected to an exterior surface of said aluminum frame member of said obelisk, thereby creating a substantially strong and sturdy apparatus that has an aesthetic design appeal due to said decorative stone covering.

Although the depiction in FIGS. 5-7 is of an obelisk 30, it is to be noted that in an alternate embodiment any different type of object can be displayed on top of said housing member 10, such as, for example, a vase, a sculpture, or any other kind of object or decorative element that is preferred by a customer and that can fit on top of a single unit or mounted on top of a stackable unit of said columbarium apparatus 100 of the present invention.

Said obelisk 30 comprises a first end 31 and a second end 32. Said first end 31 comprises a base member 33 and a plurality of sides 34, wherein said sides 34 are oriented in an upwardly perpendicular manner relative to said base 33. Said second end 32 comprises a substantially tapered end 35, thereby forming a pointed end having a substantially pyramidal shape. Said sides 34 extend upwards from said base 33 in a substantially tapered manner, thereby connecting to said tapered end 35. Said base member 33 of said first end 31 of said obelisk 30 is attachably connected to a top surface 17 of said top plate 16 of said housing member 10.

Figure 8:
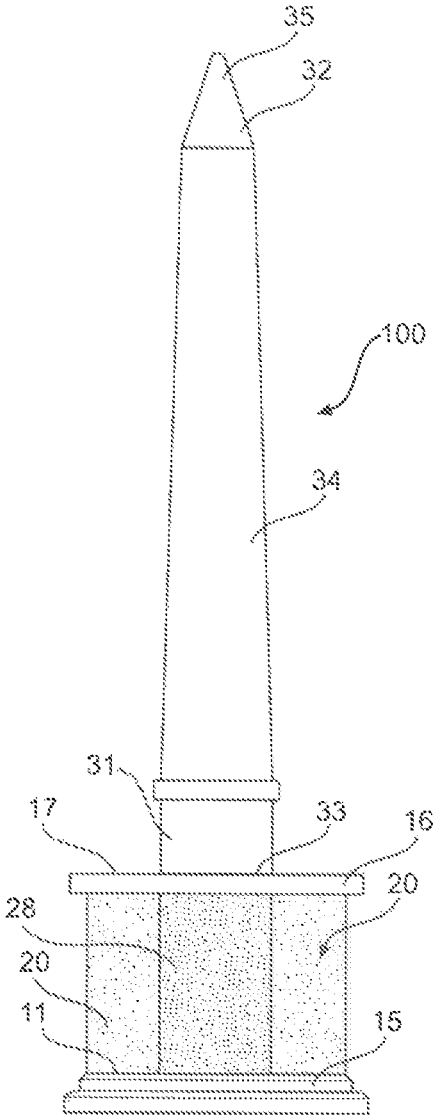
FIG. 8 depicts a side view of a preferred embodiment of a columbarium apparatus of the present invention.
Figure 9:
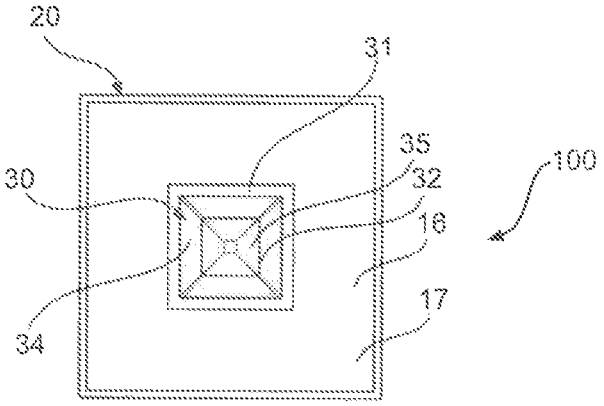
FIG. 9 depicts an aerial view of a preferred embodiment of a columbarium apparatus of the present invention.

FIG. 8 depicts a side view of columbarium apparatus 100 of the present invention, and FIG. 9 depicts an aerial view of columbarium apparatus 100 of the present invention. Said columbarium apparatus 100 of the present invention generally comprises said interior housing member 10, said exterior covering 20, and said obelisk 30.

Said interior housing member 10 comprises base member 11 and sides 12, wherein said sides 12 are oriented in an upwardly perpendicular manner relative to said base 11. As such, said base 11 and said sides 12 cooperate to form said inner cavity or reservoir 13. Additionally, said interior housing member 10 comprises opening 18, wherein opening 18 is disposed within one of said sides 12, thereby allowing for a means in which an urn can be placed into inner reservoir 13 within interior housing member 10.

Moreover, said columbarium apparatus 100 comprises base plate or slab 15, wherein said base plate 15 comprises a substantially flat and planar surface and can be disposed underneath said base member 11 of said interior housing member 10. Additionally, said columbarium apparatus 100 comprises said top plate 16, wherein said top plate 16 comprises a substantially flat and planar surface. Said top plate 16 is disposed at an opposite end of said base member 11 of said housing member 10 in a perpendicular configuration related to said sides 11, thereby enclosing said inner reservoir 13 of said housing member 10.

Said exterior covering 20 comprises a substantially flat and planar surface and is attachably connected to said sides 12 of said interior housing member 10 by way of various attachment means, such as, for example, epoxy or stainless-steel bolts. As such, said exterior covering 20 surrounds and encapsulates said sides 12 of said interior housing member 10 in order to give said columbarium apparatus 100 an aesthetic appeal.

Still referring to FIGS. 8 and 9, said columbarium apparatus 100 of the present invention further comprises said removable door member 28, wherein said door member 28 is manufactured from a substantially granite material, or any other decorative stone material exhibiting like characteristics. Said door member 28 can be removed in order to insert an urn, or said cremated remains, through opening 18 and then within said interior reservoir 13 of said columbarium apparatus 100. Said door member 28 is then temporarily secured back into place by way of a plurality of magnets and is then securely sealed into place by way of caulking said door 28 to said exterior covering 20 that is connected to sides 12 of said columbarium apparatus 100.

In a preferred embodiment, said columbarium apparatus 100 further comprises obelisk 30, or any other similar decorative element. Said obelisk 30 comprises interior frame member 36, wherein said interior frame member 36 is manufactured from an aluminum metal material. Said aluminum frame member 36 of said obelisk is then surrounded by way of said exterior covering 20, wherein said exterior covering 20 is manufactured from a granite material, or any other similar decorative stone exhibiting like characteristics. Said exterior covering 20 is attachably connected to an exterior surface of said aluminum frame member of said obelisk, thereby creating a substantially strong and sturdy apparatus that has an aesthetic design appeal due to said decorative stone covering 20.

Said obelisk 30 comprises said first end 31 and said second end 32. Said first end 31 comprises base member 33 and sides 34, wherein said sides 34 are oriented in an upwardly perpendicular manner relative to said base 33. Said second end 32 comprises said substantially tapered end 35, thereby forming a pointed end having a substantially pyramid shape. Said sides 34 extend upwards from said base 33 in a substantially tapered manner, thereby connecting to said tapered end 35. Said base member 33 of said first end 31 of said obelisk 30 is attachably connected to said top surface 17 of said top plate 16 of said housing member 10.

In a preferred embodiment, although not illustrated in FIGS. 8 and 9, at least one urn holding cremated remains is placed through opening 18 and within said inner reservoir 13 of said interior housing member 10. Said removable door 28 is then placed between said sides 12 of said interior housing member 10 by way of magnets and is then securely sealed into place, thereby enclosing and securing said urn within said reservoir 13 of said interior housing member 10. Said obelisk 30 is then placed on top of said top plate 16 and securely fastened into place.

Figure 10:
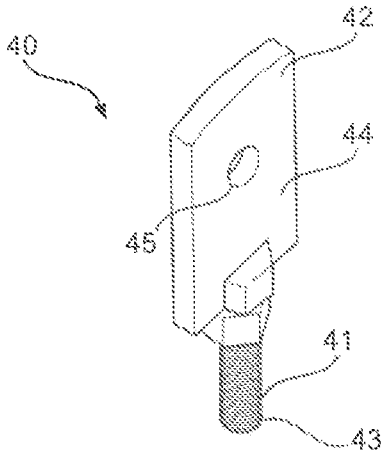
FIG. 10 depicts a side perspective view of a preferred embodiment of a lifting member of a columbarium apparatus of the present invention.

FIG. 10 depicts a side perspective view of a lifting member 40 of columbarium apparatus 100 of the present invention. Lifting member 40 comprises a first end 41 and a second end 42, wherein said first end 41 comprises a threaded connection 43 and said second end comprises a substantially flat and planar attachment member 44. Said threaded connection 43 is used to attachably connect into an interior bore 38 of said obelisk 30 (although not depicted in FIG. 10).

Said attachment member 44 of lifting member 40 further comprises a bore 45, wherein said bore 45 is used for receiving a hook, or any other similar connecting device. Said hook is used to lift said lifting member 40, and thus, said obelisk 30 and said columbarium apparatus 100 in an upward direction. This movement is utilized in order to lift and move said obelisk 30 and said columbarium apparatus 100 to a different location, thereby creating an easier means to lift and move said apparatus 100.

Figure 11:
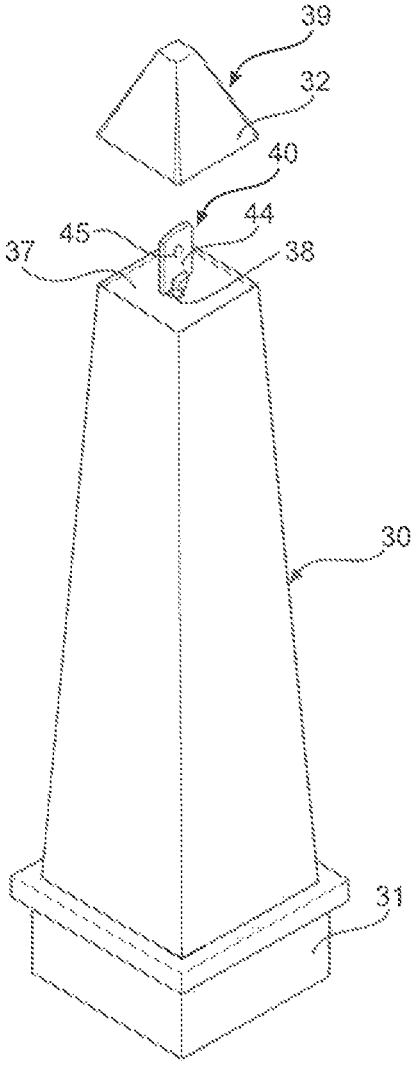
FIG. 11 depicts a side perspective view of a preferred embodiment of a columbarium apparatus of the present invention comprising a lifting member.

FIG. 11 depicts a side perspective view of columbarium apparatus 100 of the present invention comprising lifting member 40. Lifting member 40 comprises first end 41 and second end 42, wherein said first end 41 comprises a threaded connection 43 and said second end comprises substantially flat and planar attachment member 44. Said threaded connection 43 is used to attachably connect into interior bore 38 of an internal top plate 37 of said obelisk 30. Said interior bore 38 of obelisk 30 is located within said internal top plate 37 of said second end 32 of said obelisk, wherein said tapered end 35 is removably lifted from said obelisk 30, thereby forming cap member 39. Said lifting member 40 is then attachably connected to said interior bore 38 of said internal top plate 37 by way of said threaded connection 43, and then said cap member 39 is positioned back on top of said obelisk, thereby covering said lifting member 40 when lifting member 40 is not in use.

Said attachment member 44 of lifting member 40 further comprises bore 45, wherein said bore 45 is used for receiving a hook, or any other similar connecting device. Said hook is used to lift said lifting member 40, and thus, said obelisk 30 and said columbarium apparatus 100 in an upward direction. This movement is utilized in order to lift and move said obelisk 30 and said columbarium apparatus 100 to a different location, thereby creating an easier means to lift and move said apparatus 100.

Moreover, in an alternate embodiment, when said obelisk 30 is interchanged and utilized as an ossuary, said lifting member 40 can be removed from said obelisk 30, thereby providing an opening through interior bore 38 in order to insert multiple bags of cremated remains into said obelisk 30 and/or ossuary. A plug is then inserted into interior bore 38 in order to seal said bore 38. Said cap member 39 is then secured back into place on second end 32 of obelisk 30.

Figure 12:
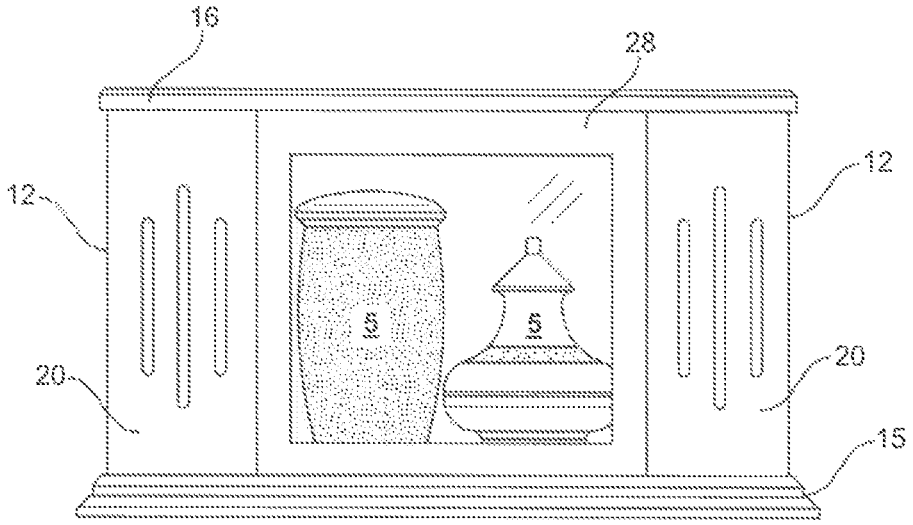
FIG. 12 depicts a side view of a preferred embodiment of an interior housing member of a columbarium apparatus of the present invention comprising a plurality of urns within said interior housing member.

FIG. 12 depicts a side view of a preferred embodiment of interior housing member 10 of columbarium apparatus 100 of the present invention comprising a plurality of urns 5 positioned within said interior housing member 10. Said interior housing member 10 comprises opening 18, wherein door member 28 is placed in order to open and/or close inner reservoir 13 of interior housing member 10. Said door member 28 can be removed in order to insert urn 5, or said cremated remains, within said interior reservoir 13 of said columbarium apparatus 100. Thus, said urn 5 holding cremated remains is placed through opening 18 and within said inner reservoir 13 of said interior housing member 10.

Said removable door 28 is then placed between exterior covering 20 that is attachably connected to said sides 12 of said interior housing member 10. Door 28 is then temporarily secured back into place by way of a plurality of magnets and is then securely sealed into place, thereby enclosing and securing said urns 5 within said reservoir 13 of said interior housing member 10. Said obelisk 30 is then placed on top of said top plate 16 and securely fastened into place.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A columbarium apparatus for use in housing cremated remains comprising:

a) an interior housing member that is manufactured from an aluminum metal material, wherein said interior housing member comprises a base, a plurality of sides, and an opening disposed on one of said sides, and wherein said base and said sides are connected together and cooperate to form an inner reservoir;

b) a top plate, wherein said top plate comprises a planar surface and is attachably connected to a top end of said sides in order to seal and enclose said inner reservoir of said interior housing member;

c) an exterior covering that is manufactured from a stone material, wherein said exterior covering is attachably connected to an exterior surface of said sides of said interior housing member;

d) a removable door member, wherein said door member is manufactured from a stone material, and said door is removably disposed over said opening of said side of said interior housing member; and e) an obelisk, wherein said obelisk comprises:

a. an interior aluminum frame member that is manufactured from an aluminum metal material, wherein said interior aluminum frame member comprises a base and a plurality of sides that are attachably connected together;

b. an exterior covering attachably connected to an exterior surface of said interior aluminum frame member, wherein said obelisk is disposed on a top surface of said top plate of said columbarium apparatus;

c. a first end and a second end, wherein said first end of said obelisk comprises said base and said plurality of sides that are attachably connected together, and wherein said second end of said obelisk comprises said plurality of sides forming a tapered end, and wherein said tapered end of said second end of said obelisk is removeable, thereby forming a cap member; and d. an interior bore located underneath said cap member, wherein said interior bore is positioned through an interior aluminum top plate of said obelisk.

2. The apparatus of claim 1, further comprising a lifting member, wherein said lifting member is disposed underneath said cap member and is attachably connected to said interior bore of said interior aluminum top plate of said obelisk.

3. The apparatus of claim 2, wherein said lifting member comprises a first end and a second end, wherein said first end comprises a threaded connection, and wherein said second end comprises a planar attachment member having a bore.

4. The apparatus of claim 3, wherein said lifting member is attachably connected to said obelisk by way of said threaded connection of said first end of said lifting member threadably connecting to said interior bore.

5. The apparatus of claim 4, wherein said obelisk comprises an ossuary located within an interior cavity of said interior aluminum frame member, and said ossuary is accessed by way of said interior bore located underneath said cap member.

* * * * *